US010788041B2

(12) United States Patent
Suelter

(10) Patent No.: US 10,788,041 B2
(45) Date of Patent: Sep. 29, 2020

(54) DUAL SEAL ARRANGEMENT FOR SUPERCHARGERS

(71) Applicant: VANDYNE SUPERTURBO, INC., Loveland, CO (US)

(72) Inventor: Barry D. Suelter, Loveland, CO (US)

(73) Assignee: SuperTurbo Technologies, Inc., Loveland, CO (US)

( * ) Notice: Subject to any disclaimer, the term of this patent is extended or adjusted under 35 U.S.C. 154(b) by 451 days.

(21) Appl. No.: 15/369,009

(22) Filed: Dec. 5, 2016

(65) Prior Publication Data

US 2017/0234316 A1 Aug. 17, 2017

Related U.S. Application Data

(60) Provisional application No. 62/267,602, filed on Dec. 15, 2015.

(51) Int. Cl.

| | |
|---|---|
| ***F04D 25/02*** | (2006.01) |
| ***F04D 17/10*** | (2006.01) |
| ***F04D 25/04*** | (2006.01) |
| ***F04D 29/62*** | (2006.01) |
| ***F04D 29/053*** | (2006.01) |
| ***F04D 29/051*** | (2006.01) |
| ***F04D 29/056*** | (2006.01) |
| ***F04D 29/08*** | (2006.01) |
| ***F04D 29/42*** | (2006.01) |

(52) U.S. Cl.

CPC ..... *F04D 25/028* (2013.01); *F04D 17/10* (2013.01); *F04D 25/045* (2013.01); *F04D 29/051* (2013.01); *F04D 29/053* (2013.01); *F04D 29/056* (2013.01); *F04D 29/083* (2013.01); *F04D 29/4206* (2013.01); *F04D 29/624* (2013.01)

(58) Field of Classification Search

CPC .. F04D 25/028; F04D 29/4206; F04D 29/056; F04D 29/051; F04D 29/053; F04D 25/045; F04D 29/083; F04D 17/10; F04D 29/624

See application file for complete search history.

(56) References Cited

U.S. PATENT DOCUMENTS

| | | | | |
|---|---|---|---|---|
| 2005/0074341 | A1* | 4/2005 | Dairokuno | F04D 13/021 417/410.1 |
| 2007/0225098 | A1* | 9/2007 | Tabata | B60K 6/365 475/5 |
| 2008/0053417 | A1* | 3/2008 | Eybergen | F02B 33/40 123/559.3 |
| 2010/0199666 | A1* | 8/2010 | VanDyne | F02B 37/105 60/605.2 |

(Continued)

*Primary Examiner* — Jacob M Amick
*Assistant Examiner* — Charles Brauch
(74) *Attorney, Agent, or Firm* — William W. Cochran; Cochran Freund & Young LLC

(57) ABSTRACT

Disclosed is an embodiment of a dual seal arrangement for the high-speed shaft of a supercharger with a centrifugal compressor and a mechanical speed step-down transmission to the shaft. A ring located about the shaft splits the rotational speed of the shaft between two seals, so that each seal spins at a speed of roughly half the speed of the shaft. The arrangement can also be used to split the shaft speed between two bearings in the same manner. The high-speed shaft may also have a turbine attached, to form a driven turbocharger.

17 Claims, 6 Drawing Sheets

(56) References Cited

U.S. PATENT DOCUMENTS

| | | | | |
|---|---|---|---|---|
| 2010/0310366 | A1* | 12/2010 | Eguchi | F01D 25/168<br>415/229 |
| 2011/0308343 | A1* | 12/2011 | Nakamura | F16H 3/006<br>74/331 |
| 2013/0061701 | A1* | 3/2013 | Wechs | F16H 3/006<br>74/330 |
| 2015/0141188 | A1* | 5/2015 | Sherrill | F02B 37/105<br>475/32 |

* cited by examiner

Shaft Seal Assembly
300
Mechanical Speed
Step-Down
Transmission
304
Second Double
Bearing
318
First Seal
320
Second Seal
322
302
Compressor
314
Housing
306
High-Speed
Shaft
312
Ring
Interfaces
310
Ring
316
First Double
Bearing

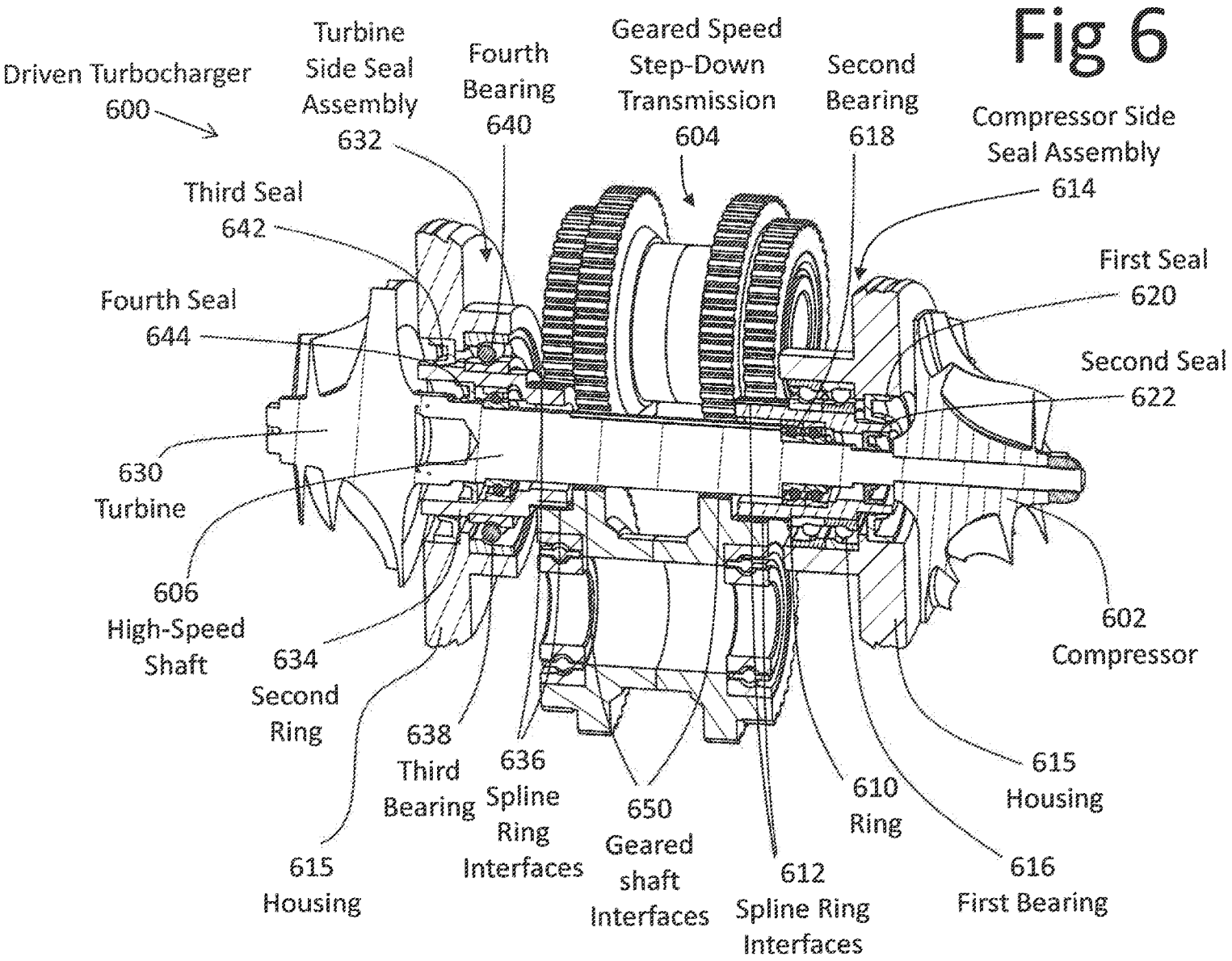
Fig 6
Compressor Side Seal Assembly 614
First Seal 620
Second Seal 622
602 Compressor
615 Housing
616 First Bearing
Second Bearing 618
610 Ring
612 Spline Ring Interfaces
Geared Speed Step-Down Transmission 604
650 Geared shaft Interfaces
636 Spline Ring Interfaces
Fourth Bearing 640
638 Third Bearing
Turbine Side Seal Assembly 632
615 Housing
634 Second Ring
Third Seal 642
Fourth Seal 644
630 Turbine
606 High-Speed Shaft
Driven Turbocharger 600

DUAL SEAL ARRANGEMENT FOR SUPERCHARGERS

BACKGROUND OF THE INVENTION

Superchargers are commonly used on engines to provide pressurized intake air to increase power and torque of the engine. One class of supercharger has a high-speed centrifugal compressor that is mechanically driven by a speed step-down transmission. This type of supercharger can have the compressor, and can also include a turbine on a common shaft with the compressor to form a driven turbocharger.

SUMMARY OF THE INVENTION

An embodiment of the invention may therefore comprise a supercharger comprising: a shaft; a compressor attached to the shaft; a mechanical speed step-down transmission that transfers power to and from the shaft; a ring located around the shaft and between the mechanical speed step-down transmission and the compressor, the ring being driven by the mechanical speed step-down transmission wherein the ring rotates at a lower speed than, and in a same direction as, the shaft; a first seal located between the ring and a housing of the supercharger; a second seal located between the shaft and the ring; wherein the first seal and the second seal inhibit fluid flow between the compressor and the mechanical speed step-down transmission.

An embodiment of the invention may further comprise a method of inhibiting fluid flow in a supercharger between a compressor and a mechanical speed step-down transmission, the method comprising attaching the compressor to a shaft, transferring power to and from the mechanical speed step-down transmission and the shaft, locating a ring around the shaft and between the mechanical speed step-down transmission and the compressor wherein the ring is driven by the mechanical speed step-down transmission and the ring rotates at a lower speed than, and in a same direction as, the shaft, locating a first seat between the ring and a housing of the supercharger, and locating a second seal between the shaft and the ring.

BRIEF DESCRIPTION OF THE DRAWINGS

FIG. 6 a cross section of a driven turbocharger that uses a geared speed step-down transmission.

DETAILED DESCRIPTION OF THE EMBODIMENTS

For a supercharger with a high-speed centrifugal compressor, the high-speed shaft may be fitted to hold the compressor with seals and bearings that will withstand high rotational speeds. This invention details an arrangement that utilizes an intermediate ring that interfaces with the mechanical speed step-down transmission to allow for dual seals and bearings that spin at roughly half of the rotational speed of the high-speed shaft.

Figure 1:
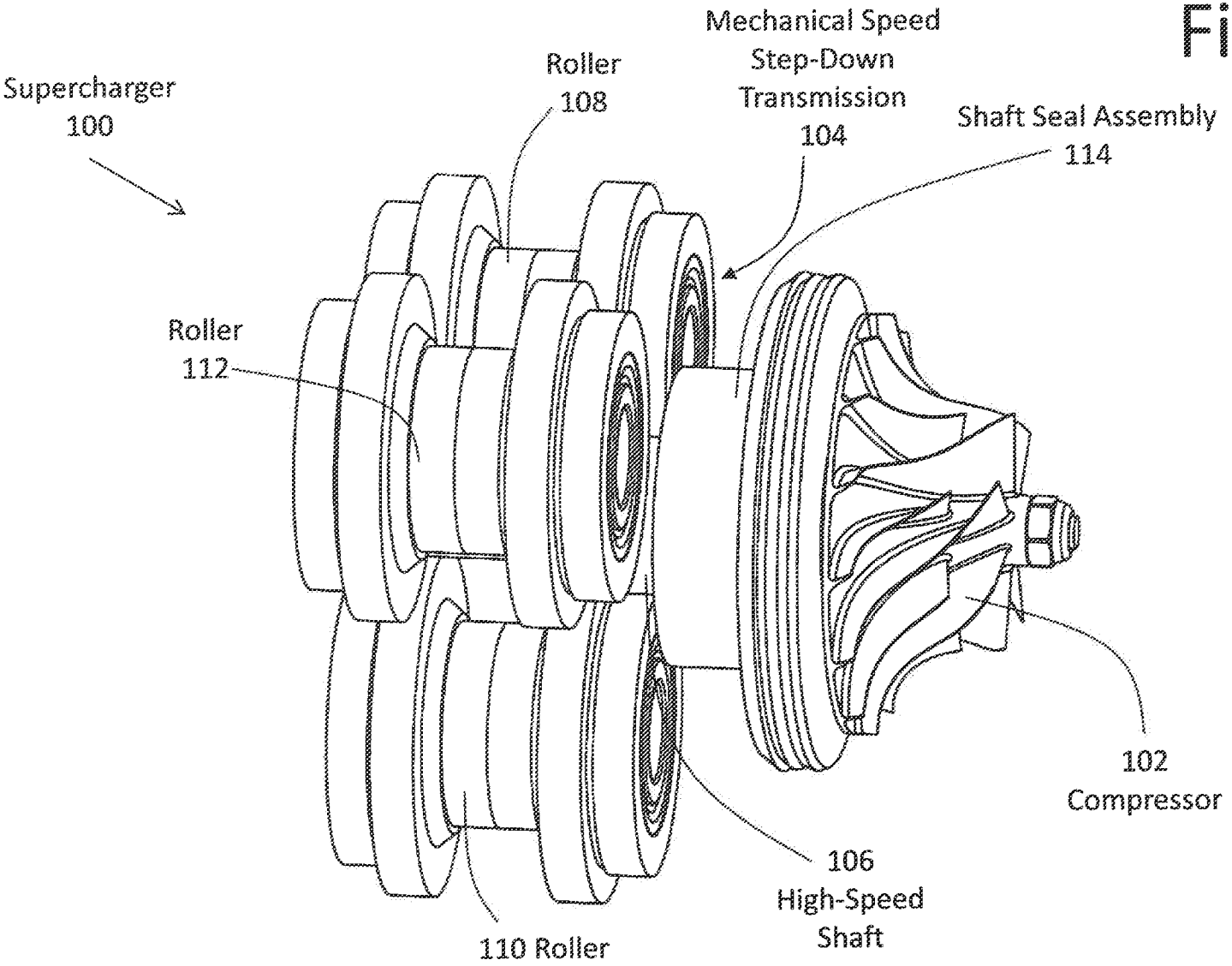
FIG. 1 is an isometric view of a supercharger with a centrifugal compressor and mechanical speed step-down transmission.

FIG. 1 shows an isometric view of a supercharger 100 with a compressor 102 and a mechanical speed step-down transmission 104. Compressor 102 is mounted on high-speed shaft 106, which in turn interfaces with mechanical speed step-down transmission 104. Since compressor 102 is a centrifugal compressor, which typically operate at high rotational speeds, mechanical speed step-down transmission 104 reduces rotational speeds to lower levels. Mechanical speed step-down transmission may be connected to an engine (not shown), either through an electric motor/generator and power electronics or an additional mechanical transmission as disclosed in U.S. Pat. No. 8,561,403, issued Oct. 22, 2013, entitled "Super-Turbocharger Having a High Speed Traction Drive and a Continuously Variable Transmission" which is specifically incorporated herein by reference for all that it discloses and teaches. Those skilled in the art will understand engine/transmission connections. As shown in FIG. 1, mechanical speed step-down transmission 104 comprises three rollers 108, 110, 112 that interface with high-speed shaft 106 and are of a larger diameter than high-speed shaft 106. Rollers 108, 110, 112 reduce the speed of high-speed shaft 106 as well as transmit torque to high-speed shaft 106 to drive compressor 102. Other embodiments of mechanical speed step-down transmission 104 may include single traction drive rollers as well as single or planetary gears. Those skilled in the art will understand single traction drive rollers and single or planetary gears. Shaft seal assembly 114 is located around high-speed shaft 106 and isolates compressor 102 from mechanical speed step-down transmission 104. Shaft seal assembly 114 inhibits fluid flow, including but not limited to traction fluid, gear oil, and compressed air, between the compressor 102 and the mechanical speed step-down transmission 104.

Figure 2:
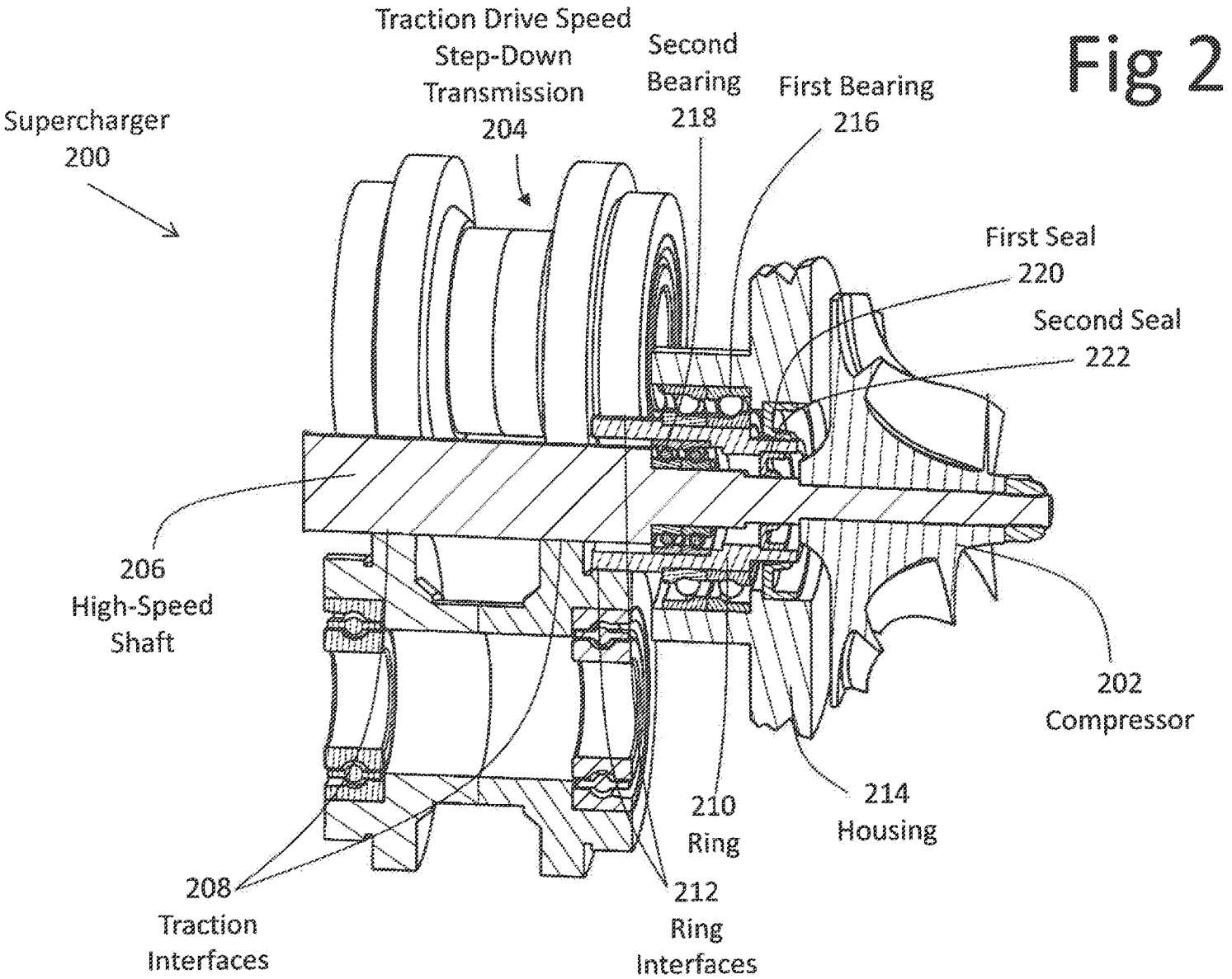
FIG. 2 is a cross section of a supercharger with a centrifugal compressor and traction drive speed step-down transmission.

FIG. 2 is a cross section of a supercharger 200 with a compressor 202 and a traction drive speed step-down transmission 204. Those skilled in the art will understand that a traction drive speed step-down transmission is a type of mechanical speed step-down transmission, which may also include gears or other speed step-down type transmissions. Compressor 202 is mounted on high-speed shaft 206. High-speed shaft 206 mates with traction drive speed step-down transmission 204 through traction interfaces 208. Traction interfaces 208 transmit power to or from high-speed shaft 206. Ring 210 is located concentrically around high-speed shaft 206. Ring 210 is driven by traction drive speed step-down transmission 204 through ring interfaces 212. Ring interfaces 212 may be traction interfaces or spline interfaces. Those skilled in the art will understand the use of traction interfaces and spline interfaces. The location of ring interfaces 212 is designed so that ring 210 spins in the same direction as high-speed shaft 206, but at a slower speed. First bearing 216 is located between a housing 214 of supercharger 200 and ring 210 and locates ring 210 around the shaft 106. First bearing 216 may comprise a single ball bearing, or dual ball bearings as shown. The number of ball bearings in the first bearing 216 may be a design consideration. Second bearing 218 is located between ring 210 and high-speed shaft 206. In some applications, second bearing 218 may not be used where traction drive speed step-down transmission 204 is used to locate high-speed shaft 206. The second bearing 218 may aid in locating high-speed shaft 206. First seal 220 is located between housing 214 and ring 210 on an exterior side of first bearing 216. In this context, the exterior side means toward the compressor 202. Second seal 222 is located between ring 210 and high-speed shaft 206 on an exterior side of second bearing 218. Together, first seal 220 and second seal 222 isolate and inhibit fluid movement between traction drive speed step-down transmission 204 and compressor 202. This fluid movement includes, but is not limited to, traction fluid and compressed air. The split seal arrangement with ring 210 allows the seals to spin at lower speeds than high-speed shaft 206, so that more traditional seals can be used. As will be understood by those skilled in the art, and as further explained in connection with FIG. 3, the speed of the seals refers to the difference in speed between the two parts that the seal creates a barrier between. Accordingly, one seal spins at the ring rotational speed minus the housing rotational speed (which is understood to be zero). The other seal spins at the rotational speed of the shaft minus the rotational speed of the ring. The dimensions of ring 210 and ring interfaces 212 can be designed to spin ring 210 at a desired speed that is optimal for first and second seals 220, 222. First seal 220 is located radially outward from second seal 222, so is larger diameter and will have a lower maximum speed than second seal 222. For example, ring 210 can be designed to spin at 40% of the speed of high-speed shaft 206, so for a high-speed shaft speed of 100,000 rpm, ring 210 spins at 40,000 rpm, and correspondingly first and second seals 220, 222 spin at 40,000 rpm and 60,000 rpm. With the lowered rotational speeds, seals such as lip seals, for example, can be used for first and second seals 220, 222.

Figure 3:
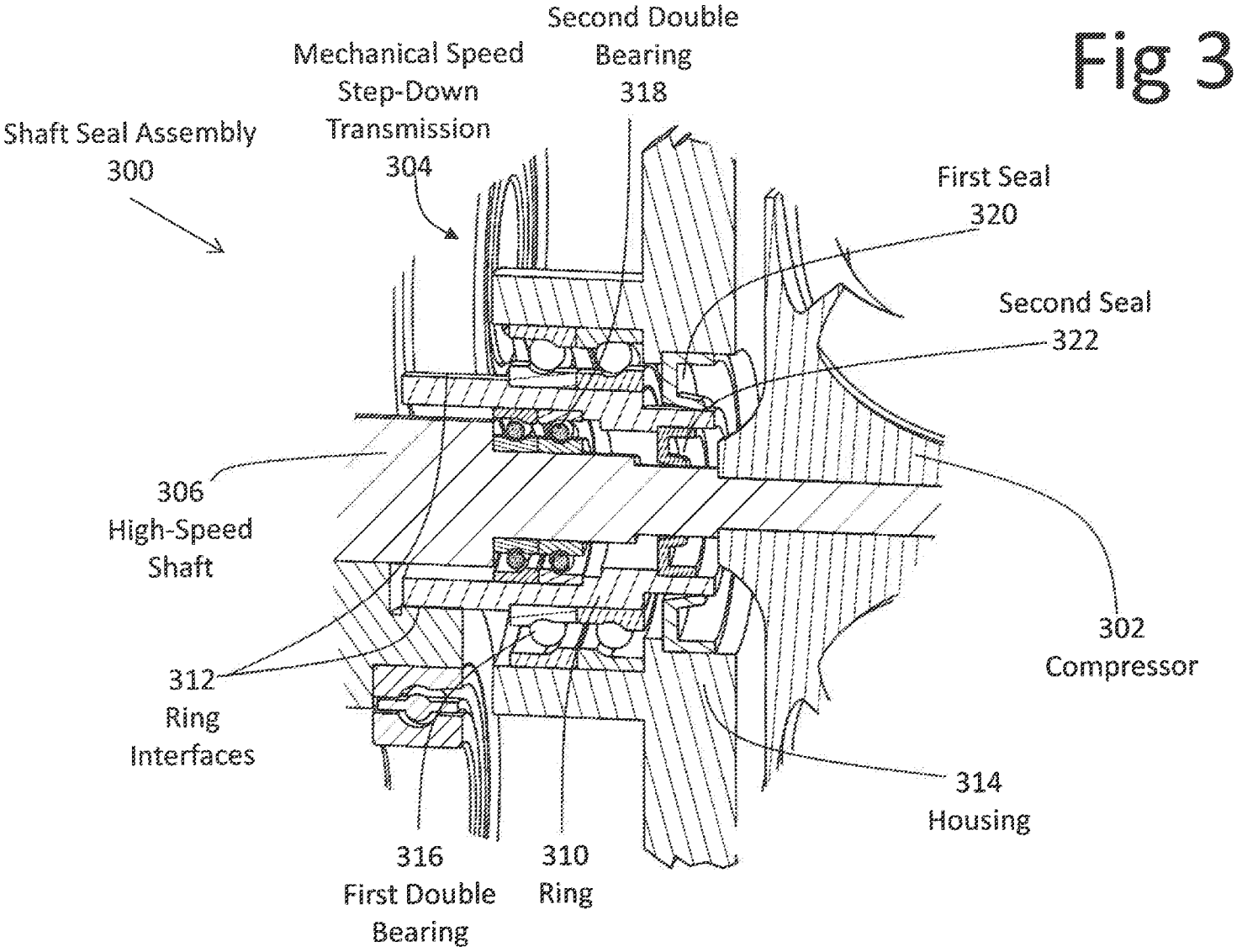
FIG. 3 a close up cross section view of the shaft seal assembly from FIG. 2.

FIG. 3 is a close up cross section view of the shaft seal assembly 300 from FIG. 2. High-speed shaft 306 requires sealing to prevent fluid movement between compressor 302 and mechanical speed step-down transmission 304. The speeds that high-speed shaft 306 operates at may be too high for many conventional seals. Accordingly, dividing this high rotational speed between more than one seal can enable use of lip seals and other lower speed seals, known by those skilled in the art. This division in rotational speed is done by placing a ring 310 around high-speed shaft 306 that is driven by mechanical speed step-down transmission 304 at a lower rotational speed than high-speed shaft 306. The relative rotational speeds between high-speed shaft 306 and ring 310, as well as ring 310 and housing 314, may be roughly half of the rotational speed of high-speed shaft 310. First seal 320 is located between housing 314 and ring 310, and second seal 322 is located between ring 310 and high-speed shaft 306. Together, first seal 320 and second seal 322 each spin at roughly half the rotational speed of high-speed shaft 306, and prevent fluid flow between compressor 302 and mechanical speed step-down transmission 304. As shown in FIG. 3, first seal 320 and second seal 322 can be traditional lip seals, but other types of seals are possible as well.

Ring 310 must be held in place, so at least one bearing is needed between housing 314 and ring 310. As shown in FIG. 3, first double bearing 316 is composed of two back-to-back ball hearings and is located between housing 314 and ring 310. Placing two ball bearings in such a way allows for axial thrust forces to be transmitted through first double bearing 316 in both axial directions. Other bearing arrangements can also be utilized. In this way, first double bearing 316 locates ring 310. As described in connection with FIG. 2, ring 310 is driven by mechanical speed step-down transmission 304 through ring interfaces 312. The dimensions of these ring interfaces 312 are designed so that ring 310 spins at a designed speed to keep first seal 320 and second seal 322 within their design requirements. Additionally, second double bearing 318 can be used between ring 310 and high-speed shaft 306 to locate high-speed shaft 306. Like first double bearing 316, second double bearing 318 is shown as two back-to-back ball bearings with mirrored axes so that axial thrust forces can be transmitted in either direction. This way, thrust forces on high-speed shaft 306 from compressor 302 can be transmitted through second double bearing 318, ring 310, and first double bearing 316 to housing 314. It is understood that the invention herein described is not limited to any particular bearing arrangement. Those skilled in the art will understand the bearing arrangements described herein as well as other bearing arrangements. Other bearing arrangements can also be utilized, depending on the requirements of the system.

Figure 4:
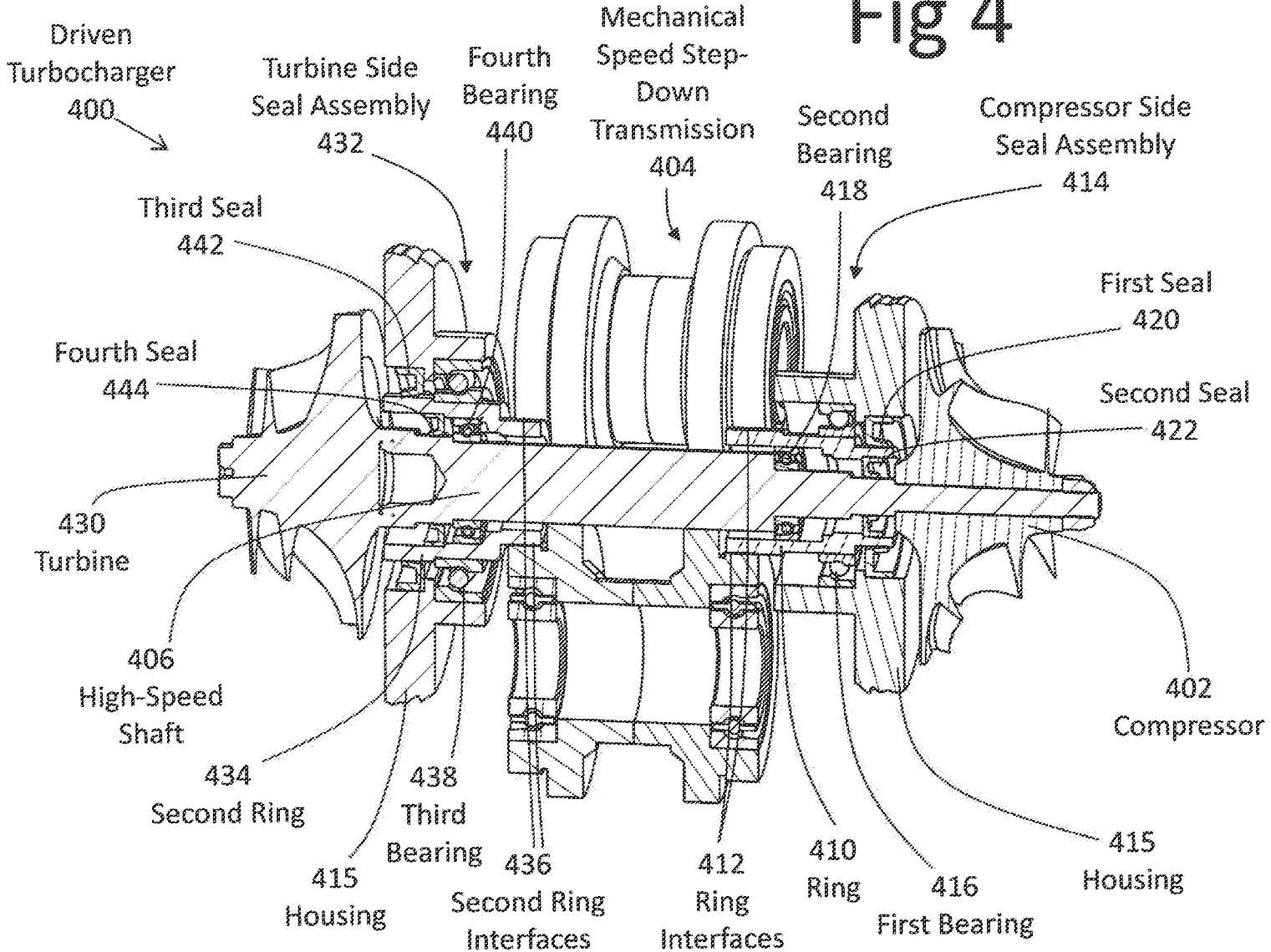
FIG. 4 is a cross section of a driven turbocharger with a centrifugal compressor, a turbine, and a traction drive speed step-down transmission.

FIG. 4 is a cross section of a driven turbocharger 400 showing a turbine 430 on an opposite end of high-speed shaft 406 from the compressor 402. The addition of turbine 430 introduces a second section of high-speed shaft 406 that must be sealed to prevent fluid movement. The compressor side seal assembly 414 is substantially the same as described in connection with FIGS. 1-3. Ring 410 is located around high-speed shaft 406 and is located by first bearing 416. First seal 420 is located between housing 415 and ring 410 and second seal 422 is located between ring 410 and high-speed shaft 406. First seal 420 and second seal 422 prevent fluid flow between compressor 402 and mechanical speed step-down transmission 404. Additionally, a second bearing 418 may be used between ring 410 and high-speed shaft 406 to locate high-speed shaft 406. Ring 410 is driven at a designed speed by mechanical speed step-down transmission 404 through ring interfaces 412.

A turbine side seal assembly 432 is shown that follows the same design principles as the compressor side seal assembly 414. A second ring 434 is located around high-speed shaft 406 between mechanical speed step-down transmission 404 and turbine 430. The second ring 434 is driven by mechanical speed step-down transmission 404 through second ring interfaces 436. Third bearing 438 locates second ring 434. Third seal 442 is located between housing 415 and second ring 434. Fourth seal 444 is located between second ring 434 and high-speed shaft 406. Third seal 442 and fourth seal 444 inhibit fluid flow between the turbine 430 and the mechanical speed step-down transmission 404. A fourth bearing 440 may be used to help locate high-speed shaft 406, and is located between second ring 434 and high-speed shaft 406. As shown, second bearing 418 and fourth bearing 440 are used to locate high-speed shaft 406, and are oriented to prevent axial movement of high-speed shaft 406 from thrust forces from compressor 402 and turbine 430. The use of ring 410 and second ring 434 lowers the speeds of seals 420, 422, 442 and 444 and bearings 416, 418, 438 and 440 as compared to the speed of high-speed shaft 406 and thereby lowers the design requirements for these components.

Figure 5:
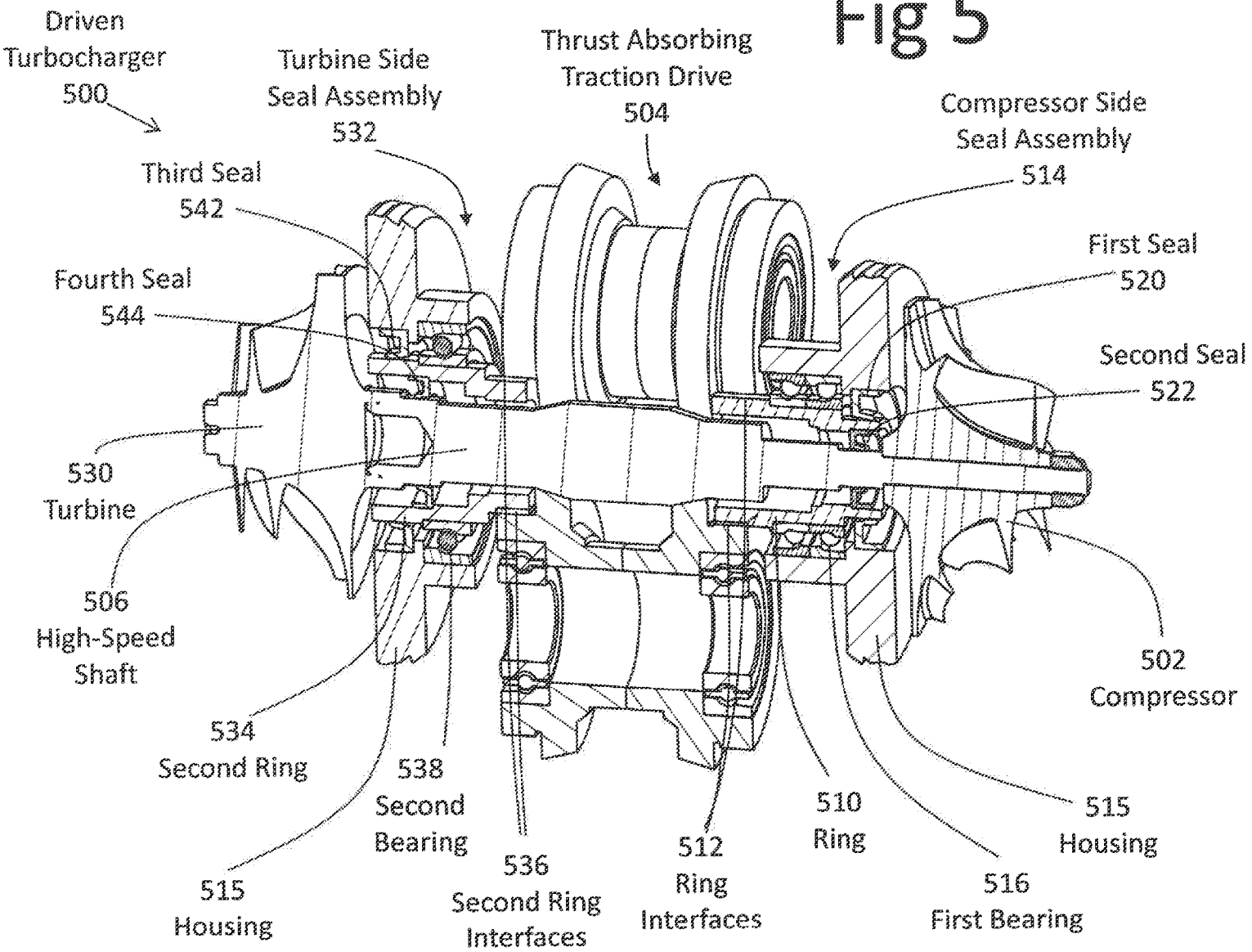
FIG. 5 a cross section of a driven turbocharger that uses a thrust absorbing traction drive to drive the high-speed shaft.

FIG. 5 is a cross section of a driven turbocharger 500 showing a thrust absorbing traction drive 504 to drive high-speed shaft 506. The thrust absorbing traction drive fully locates high-speed shaft 506 so that no other bearings on high-speed shaft 506 are necessary as taught in U.S. Patent Application Ser. No. 61/906,938, filed Nov. 21, 2013, entitled "Thrust Absorbing Planetary Traction Drive Superturbo," which has been specifically incorporated herein by reference for all that it discloses and teaches. The compressor side seal assembly 514 and turbine side seal assembly 532 are similar as described in regard to FIGS. 1-4. Ring 510 is located around high-speed shaft 506 between compressor 502 and thrust absorbing traction drive 504. Ring 510 is located by first bearing 516. First seal 520 is located between housing 515 and ring 510. Second seal 522 is located between ring 510 and high-speed shaft 506. First seal 520 and second seal 522 prevent fluid flow between compressor 502 and thrust absorbing traction drive 504. Second ring 534 is located around high-speed shaft 506 between turbine 530 and thrust absorbing traction drive 504. Second ring 534 is located by second bearing 538. Third seal 542 is located between housing 515 and second ring 534. Fourth seal 544 is located between ring 534 and high-speed shaft 506. Third seal 542 and fourth seal 544 prevent fluid flow between turbine 530 and thrust absorbing traction drive 504. Ring 510 is driven by thrust absorbing traction drive 504 through ring interfaces 512 so that ring 510 spins at a designed speed relative to high-speed shaft 506. Similarly, second ring 534 is driven by thrust absorbing traction drive 504 through second ring interfaces 536. Accordingly, second ring 534 spins at a designed speed relative to high-speed shaft 506. Seals 520, 522, 542, 544 spin at lower speeds than high-speed shaft 506 allowing more conventional seals such as lip seals to be used.

FIG. 6 is a cross section of a driven turbocharger 600 showing a geared speed step-down transmission 604. The function of the compressor side seal assembly 614 and the turbine side seal assembly 632 is the same as described in FIGS. 1-5. The drive mechanism and interfaces for the step-down transmission shown in FIG. 5 are variations of such. Ring 610 and second ring 634 are driven by spline ring interfaces 612 and 636 with geared speed step-down transmission 604. High-speed shaft 606 is driven by geared speed step-down transmission 604 through geared shaft interfaces 650. Ring 610 is located around high-speed shaft 606 and is located by first bearing 616. First seal 620 is located between housing 615 and ring 610. Second seal 622 is located between ring 610 and high-speed shaft 606. First seal 620 and second seal 622 prevent fluid flow between compressor 602 and geared speed step-down transmission 604. A second bearing 618 is located between ring 610 and high-speed shaft 606 to locate high-speed shaft 606. Second ring 634 is located around high-speed shaft 606 between geared speed step-down transmission 604 and turbine 630. Second ring 634 is located by third hearing 638. Third seal 642 is located between housing 615 and second ring 634. Fourth seal 644 is located between second ring 634 and high-speed shaft 606. Third seal 642 and fourth seal 644 prevent fluid flow between turbine 630 and geared speed step-down transmission 604. A fourth bearing 640 is used in conjunction with second bearing 618 to locate high-speed shaft 606. Fourth bearing 640 is located between second ring 634 and high-speed shaft 606. Seals 620, 622, 642, 644 spin at lower speeds than high-speed shaft 506 so that more conventional seals such as lip seals can be used. Similarly, bearings 616, 618, 638, 640 together locate high-speed shaft 606, but spin at lower speeds than high-speed shaft 606 and there by lower design requirements regarding speed limitations of the bearings.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A supercharger comprising:

a shaft;

a compressor attached to said shaft;

a mechanical speed step-down transmission that transfers power to and from said shaft;

a ring located around said shaft and between said mechanical speed step-down transmission and said compressor, said ring being driven by said mechanical speed step-down transmission wherein said ring rotates at a lower speed than, and in a same direction as, said shaft;

a first seal located between said ring and a housing of said supercharger;

a second seal located between said shaft and said ring;

wherein said first seal and said second seal inhibit fluid flow between said compressor and said mechanical speed step-down transmission;

a turbine attached to said shaft;

a second ring located around said shaft and between said mechanical speed step-down transmission and said turbine, said second ring being driven by said mechanical speed step-down transmission, wherein said second ring rotates at a lower speed than, and in a same direction as, said shaft;

a third seal located between said second ring and said housing of said supercharger;

a fourth seal located between said shaft and said second ring;

wherein said third seal and said fourth seal inhibit fluid flow between said turbine and said mechanical speed step-down transmission.

2. The supercharger of claim 1 further comprising:

a first bearing located between said housing of said supercharger and said ring, wherein said first hearing locates said ring.

3. The supercharger of claim 2 further comprising:

a second bearing located between said ring and said shaft wherein said second bearing locates said shaft.

4. The supercharger of claim 3 wherein said first bearing and said second bearing absorb axial thrust forces on said shaft.

5. The supercharger of claim 1 further comprising:

a third bearing located between said housing of said supercharger and said second ring wherein said third bearing locates said second ring.

6. The supercharger of claim 5 further comprising:

a fourth bearing located between said second ring and said shaft wherein said fourth bearing locates said shaft.

7. The supercharger of claim 1 wherein said mechanical speed step-down transmission is a traction drive transmission.

8. The supercharger of claim 7 wherein said traction drive transmission is a planetary traction drive transmission.

9. The supercharger of claim 1 wherein said mechanical speed step-down transmission is a thrust absorbing traction drive transmission.

10. The supercharger of claim 1 wherein said mechanical speed step-down transmission is a geared transmission.

11. The supercharger of claim 1 wherein said mechanical speed step-down transmission drives said ring through a traction interface.

12. The supercharger of claim 1 wherein said mechanical speed step-down transmission drives said ring through a spline interface.

13. The supercharger of claim 1 wherein said first seal and said second seal are lip seals.

14. The supercharger of claim 1 wherein said third seal and said fourth seal are lip seals.

15. A method of inhibiting fluid flow in a supercharger between a compressor and a mechanical speed step-down transmission, said method comprising:

attaching said compressor to a shaft;

transferring power to and from said mechanical speed step-down transmission and said shaft;

locating a ring around said shaft and between said mechanical speed step-down transmission and said compressor wherein said ring is driven by said mechanical speed step-down transmission and said ring rotates at a lower speed than, and in a same direction as, said shaft;

locating a first seal between said ring and a housing of said supercharger;

locating a second seal between said shaft and said ring attaching a turbine to said shaft;

locating a second ring around said shaft and between said mechanical speed step-down transmission and said turbine wherein said second ring is driven by said mechanical speed step-down transmission and said second ring rotates at a lower speed than, and in a same direction as, said shaft;

locating a third seal between said second ring and said housing of said supercharger;

locating a fourth seal between said shaft and said second ring.

16. The method of claim 15 wherein said mechanical speed step-down transmission is a traction drive transmission.

17. The method of claim 15 wherein said mechanical speed step-down transmission is a geared transmission.

* * * * *